US010808198B2

(12) United States Patent
Fang

(10) Patent No.: US 10,808,198 B2
(45) Date of Patent: Oct. 20, 2020

(54) LUBRICANT CONTAINING THIADIAZOLE DERIVATIVES

(71) Applicant: Afton Chemical Corporation, Richmond, VA (US)

(72) Inventor: Xinggao Fang, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 16/249,400

(22) Filed: Jan. 16, 2019

(65) Prior Publication Data

US 2020/0224114 A1 Jul. 16, 2020

(51) Int. Cl.

| | |
|---|---|
| ***C10M 135/36*** | (2006.01) |
| ***C10M 107/02*** | (2006.01) |
| ***C10M 133/44*** | (2006.01) |
| ***C10M 141/08*** | (2006.01) |
| ***C10M 169/04*** | (2006.01) |
| *C10N 30/06* | (2006.01) |
| *C10N 30/00* | (2006.01) |
| *C10N 40/04* | (2006.01) |

(52) U.S. Cl.

CPC ..... *C10M 135/36* (2013.01); *C10M 107/02* (2013.01); *C10M 133/44* (2013.01); *C10M 141/08* (2013.01); *C10M 169/04* (2013.01); *C10M 2205/0206* (2013.01); *C10M 2215/30* (2013.01); *C10M 2219/106* (2013.01); *C10N 2030/06* (2013.01); *C10N 2030/42* (2020.05); *C10N 2030/43* (2020.05); *C10N 2030/45* (2020.05); *C10N 2040/04* (2013.01); *C10N 2040/042* (2020.05); *C10N 2040/044* (2020.05)

(58) Field of Classification Search

CPC combination set(s) only.
See application file for complete search history.

(56) References Cited

U.S. PATENT DOCUMENTS

| | | | |
|---|---|---|---|
| 4,719,001 | A | 1/1988 | Dvoracek |
| 5,585,338 | A | 12/1996 | Beltzer |
| 5,656,577 | A | 8/1997 | Kato |
| 5,801,130 | A | 9/1998 | Francisco |
| 2010/0016189 | A1 | 1/2010 | Baker |
| 2010/0130390 | A1 | 5/2010 | Tipton |
| 2016/0168505 | A1 | 6/2016 | Bouvier et al. |

FOREIGN PATENT DOCUMENTS

| | | | | |
|---|---|---|---|---|
| CN | 101857580 | A | 10/2010 | |
| CN | 101830865 | B | 5/2012 | |
| CN | 104087390 | A1 | 10/2014 | |
| CN | 104725740 | A1 | 6/2015 | |
| EP | 0210366 | A1 | 4/1989 | |
| EP | 310364 | A1 | 4/1989 | |
| EP | 0310366 | A1 * | 4/1989 | ..... C10M 163/00 |
| EP | 0391649 | A2 | 10/1990 | |
| EP | 0524452 | A1 | 1/1993 | |
| EP | 1191087 | A1 | 8/2001 | |
| EP | 1191087 | A1 * | 3/2002 | ..... C10M 135/36 |
| EP | 1918356 | A | 5/2008 | |
| EP | 2829591 | A1 | 1/2015 | |
| EP | 2829592 | A1 | 1/2015 | |
| WO | 88/03551 | | 5/1988 | |
| WO | 20090111235 | A2 | 9/2009 | |
| WO | 20100141003 | A1 | 12/2010 | |
| WO | 20120112635 | A1 | 8/2012 | |

OTHER PUBLICATIONS

European Search Report; dated Jun. 17, 2020 for EP Application No. 20151851.1.

* cited by examiner

*Primary Examiner* — Taiwo Oladapo
(74) *Attorney, Agent, or Firm* — Honigman LLP

(57) ABSTRACT

The present disclosure describes a lubricating composition including a) a major part of a base oil of lubricating viscosity wherein the base oil is selected from API Group I, II, III, IV, V, or mixtures thereof, b) a total of 0.001 to 0.536 wt. %, based on the total lubricating composition, of one or more monohydrocarbyl-substituted dimercaptothiadiazole derivative(s) according to Formula (I), or a tautomer or salt thereof, below Formula I

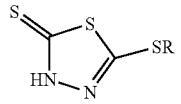

wherein R is methyl or $C_2$ to $C_4$ alkyl, wherein the total lubricating composition has a sulfur content of up to 2,500 ppm (wt.), c) less than 0.1 wt % phosphite.

The disclosure further describes the use of the lubricating composition for lubricating a driveline, a transmission including a manual or automated transmission, a gear, an automated gear, or an axle, and for enhanced FZG test performance. The disclosure further relates to a method for preparing the lubricating composition.

13 Claims, No Drawings

LUBRICANT CONTAINING THIADIAZOLE DERIVATIVES

FIELD

This disclosure relates to novel additive compositions and lubricating compositions, including lubricating compositions for use in driveline, transmission, gears or axles. Furthermore, the disclosure describes the use of an additive composition and a lubricant composition for enhancing FZG test performance.

BACKGROUND

Different applications of lubricants require different properties and performance characteristics, often leading to a delicate balancing of components. The difficulties are multiplied by the fact that some components may, to the detriment of the lubricant's performance, chemically interact with each other. Further challenges arise from environmental and legal requirements, e.g. setting ever stricter maximum levels of sulfur, phosphorus, and other performance standards.

It is therefore, on the one hand, generally desirable to reduce the levels of sulfur and phosphorus, in particular phosphites, in lubricants exposed to high pressure and load. On the other hand, antiwear and extreme pressure performance is often associated with the presence of sulfur and phosphite additives.

Lubricating compositions for driveline applications, in particular automotive driveline applications, such as transmissions (manual and automatic) clutches, gearboxes, axles, or differentials need to provide antiwear, extreme pressure and loadbearing capacity. Amongst the antiwear properties, anti-scuffing is particularly desirable. Scuffing, can be measured and objectively determined using the CEC L-84-02 industry standard test to evaluate gear scuffing. This test measures anti-scuffing properties of oil for reduction gears, hypoid gears, automatic transmission gears and the like. The test uses a FZG A10-type pinion with a width of 10 mm, and a wheel width of 20 mm. The motor is run at a wheel rotational speed of 2880 rpm and a circumferential speed of 16.6 m/s for a total run duration of 7 minutes and 30 seconds at an initial lubricant oil temperature of 90° C. The results reported include load stage failure. Typically, better results are obtained for lubricants reporting a higher load stage failure.

Dimercaptothiadiazole (DMTD, Formula (I) with R=H) is a known additive in lubricating compositions, providing antiwear performance. DMTD, however, has the disadvantage of low solubility in lubricating oils, requiring premixing with a dispersant before adding to an additive package or lubricating composition. Still, DMTD tends to drop out of solution.

Another class of known additives with better oil solubility is 2,5-bis (hydrocarbyldithio)-1,3,4-thiadiazole and 2-hydrocarbyldithio-5-mercapto-1,3,4-thiadiazole. These additives suffer from instability, high reactivity and interaction with other components, leading to reduced performance. Therefore, Automatic Transmission Fluids (ATFs) relying on those additives may experience decreased performance in many areas.

Various classes of thiadiazole-derived compounds including above mentioned 2,5-bis (hydrocarbyldithio)-1,3,4-thiadiazole and 2-hydrocarbyldithio-5-mercapto-1,3,4-thiadiazole are suggested for use as components in complex transmission fluids by US 2016/0168505 A1. However, as an essential component, phosphites are required, and total sulfur levels are not disclosed.

The present disclosure provides an additive for a driveline lubricant, or a driveline lubricant, that is low in sulfur content and low in phosphite content. The disclosure also provides enhanced anti-wear, specifically gear anti-scuffing properties to a driveline lubricating composition of low total sulfur content and very little, or no phosphite present.

SUMMARY

The present disclosure relates to a lubricating composition comprising:

a) a major part of a base oil of lubricating viscosity wherein the base oil is selected from API Group I, II, III, IV, V, or mixtures thereof, b) a total of 0.001 to 0.536 wt. %, based on the total lubricating composition, of one or more monohydrocarbyl-substituted dimercaptothiadiazole derivatives according to Formula I or a tautomer or salt thereof below Formula I

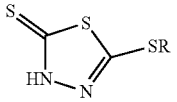

wherein R is methyl or $C_2$ to $C_4$ alkyl, wherein the total lubricating composition has a sulfur content of up to 2,500 ppm (wt.), and c) less than 0.1 wt % phosphite.

The use of the monohydrocarbyl-substituted dimercaptothiadiazole of Formula (I) according to the disclosure leads to more stable lubricating compositions, allowing reduced total sulfur at equal or improved gear scuffing resistance.

In particular, the gear scuffing resistance is surprisingly improved compared to conventional agents such as dimercaptodiazole (Formula (I) with R=H) or 2,5-bis (hydrocarbyldithio)-1,3,4-thiadiazole and 2-hydrocarbyldithio-5-mercapto-1,3,4-thiadiazole. Furthermore, a surprising synergy exists using a mixture of 2,5-bis (hydrocarbyldithio)-1,3,4-thiadiazole and 2-hydrocarbyldithio-5-mercapto-1,3,4-thiadiazole with monohydrocarbyl-substituted dimercaptothiadiazole of Formula (I) according to the disclosure, allowing even lower sulfur limits and lower overall treat rates at optimal wear resistance, including gear scuffing resistance.

The skilled person understands that monohydrocarbyl-substituted dimercaptothiadiazole derivatives of Formula (I) according to the disclosure may be present in a tautomeric equilibrium and in salted forms when exposed to other additives in a lubricant composition.

In the present disclosure, in all cases wherein it is referred to monohydrocarbyl-substituted dimercaptothiadiazole derivatives, those of Formula (I) are meant, and the tautomeric forms and salted forms are herein treated as synonyms. Thus, e.g. 5-hydrocarbyl-1,3,4-thiadiazol-2-thiol, 2-hydrocarbyl-1,3,4-thiadiazol-5-thiol, 2-hydrocarbyl-5-mercapto-1,3,4-thiadiazol or 5-(hydrocarbylthio)-3,4-thiadiazole-2(3H)-thione all describe the same compound.

In one embodiment, the lubricating composition according to the disclosure contains less than 0.05 wt. % phosphite, or less than 0.01 wt. % phosphite, or less than 0.001 wt. % phosphite. In another embodiment, the composition is essentially free of phosphite.

In one embodiment, the lubricating composition according to the disclosure has a sulfur content of less than 2,500 ppm (wt.), 2,000 ppm (wt.) or 1,800 ppm (wt.), up to 1,500. In another embodiment, the sulfur content is less than 1,500 ppm (wt.) or up to 1,200. In another embodiment, the sulfur content is less than 1200 ppm (wt.) and up to 1,000 or less than 1,000 ppm (wt.).

In one embodiment, the lubricating composition may have a combination of low sulfur and low phosphite, such as less than 2500 ppm (wt.) sulfur and less than 0.1 wt % phosphite, or 2,000 ppm (wt.) sulfur and less than 0.01 wt. % phosphite, or less than 2,000 ppm (wt.) sulfur and less than 0.001 wt. % phosphite, or less than 1,800 ppm (wt.) sulfur and less than 0.01 wt. % phosphite, or less than 1,800 ppm (wt.) sulfur and less than 0.001 wt. % phosphite, or even less than 1,500 ppm (wt.) sulfur and less than 0.01 wt. % phosphite, or less than 1,500 ppm (wt.) sulfur and less than 0.001 wt. % phosphite, or even less than 1,000 ppm (wt.) sulfur and less than 0.01 wt. % phosphite, or less than 1,000 ppm (wt.) sulfur and less than 0.001 wt. % phosphite.

In one embodiment of the disclosure, the monohydrocarbyl-substituted dimercaptothiadiazole derivative(s) according to Formula (I) are present in a total of 0.001 to 0.4 wt. %, or 0.001 to 0.40 wt. %, or 0.005 to 0.400 wt. %, or 0.01 to 0.3, or 0.05 to 0.2 wt. %, based on the total lubricating composition.

As described above, the monohydrocarbyl-substituted dimercaptothiadiazole derivative(s) used in the present disclosure are monoalkyl dimercaptothiadiazole derivative(s). In one embodiment, the alkyl group may be methyl, or it may be ethyl, propyl or butyl, or any combination of $C_1$ to $C_4$ alkyl. In another embodiment, the alkyl group is methyl.

Advantageously, the monohydrocarbyl-substituted dimercaptothiadiazole derivative(s) contributes 200 to 1,500 or 400 to 1,000 ppm sulfur to the lubricating composition.

In one embodiment, the lubricating composition of the present disclosure contains a dispersant. In one embodiment, the lubricating composition contains 0.001 to 10 wt. %, based on the total lubricating composition, of the dispersant. In another embodiment, the dispersant is present in an amount of 0.01 to 8 wt %. In another embodiment, the dispersant is 0.1 to 5 wt. % in the lubricating composition, based on the total weight of the lubricating composition.

In the present disclosure, the dispersants may be selected from the group consisting of ashless dispersants, borated ashless dispersants, ash-containing dispersants, and dispersant viscosity index improvers, and mixtures thereof. In one embodiment, the dispersant is an ashless dispersant selected from the group consisting of succinimide dispersants, polyisobutylene dispersants, and ethylene-propylene copolymers, and mixtures thereof. In another embodiment, the dispersant is a succinimide dispersant.

As mentioned above, a synergy in gear scuffing resistance is observed if 0.001 to 0.20 wt. % of one or more monohydrocarbyl-substituted dimercaptothiadiazole derivative(s) are combined with 0.01 to 0.40 wt. % mono- and/or bishydrocarbylthio-substituted dimercaptothiadiazole(s) of Formula II/IIa. In another approach, the lubricating composition includes a combination of 0.01 to 0.15 wt. % of one or more monohydrocarbyl-substituted dimercaptothiadiazole derivative(s) with 0.05 to 0.20 wt. % mono- and/or bishydrocarbylthio-substituted dimercaptothiadiazole(s).

Formula (II)

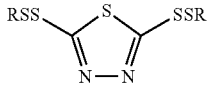

-continued

Formula (IIa)

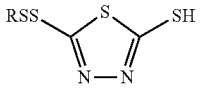

wherein R is independently, $C_5$-$C_{15}$ alkyl.

The lubricating composition according to the disclosure may further comprise one or more additives selected from the group consisting of extreme-pressure agents, anti-wear agents, friction modifiers, metal deactivators, detergents, viscosity index improvers, antioxidants, corrosion inhibitors, foam inhibitors, demulsifiers, pour point depressants, seal swelling agents, and mixtures thereof.

In an aspect of the disclosure, the lubricating composition is used for lubricating a driveline, a transmission including a manual or automated transmission, a gear, an automated gear, or an axle.

In another aspect of the disclosure, the lubricating composition is used for enhanced FZG test performance.

A further aspect of the disclosure is the use of or a method of lubricating by including a total of 0.001 to 0.536 wt. %, based on the total lubricating composition, of one or more monohydrocarbyl-substituted dimercaptothiadiazole derivative(s) according to Formula (I) or a tautomer or salt thereof below Formula (I)

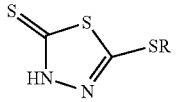

wherein R is methyl or $C_2$ to $C_4$ alkyl, in a lubricating composition comprising a major part of a base oil of lubricating viscosity wherein the base oil is selected from API Group I, II, II, IV, V, or mixtures thereof, wherein the total lubricating composition has a sulfur content of up to 2,500 ppm (wt.), to enhance the gear scuffing resistance of the lubricating composition. It is to be understood that this aspect contemplates all options and limitations described in connection with the lubricating composition of the disclosure, individually or in combination. For example, the disclosure also relates to the use of any of the amounts of one or more monohydrocarbyl-substituted dimercaptothiadiazole derivative(s) according to Formula (I) or a tautomer or salt thereof in a lubricating composition of the disclosure to enhance the gear scuffing resistance of the lubricating composition.

A further aspect of the disclosure is a method of preparing a lubricant comprising blending a base oil of lubricating viscosity wherein the base oil is selected from API Group I, II, III, IV, V, or mixtures thereof with one or more monohydrocarbyl-substituted dimercaptothiadiazole derivative(s) according to Formula (I) or a tautomer thereof

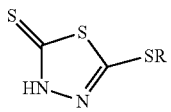

wherein R is methyl or $C_2$ to $C_4$ alkyl to form a lubricant having a sulfur content of up to 2,500 ppm (wt.) and containing less than 0.1 wt % phosphite, wherein the lubricating composition comprises a major part of the base oil and a total of 0.001 to 0.536 wt. %, based on the total lubricating composition, of the one or more monohydrocarbyl-substituted dimercaptothiadiazole derivative(s) according to Formula (I) or a tautomer thereof.

The method may involve dissolving the compound according to Formula (I) in the base oil in the presence of a dispersant. Viscosity may eventually be adjusted by addition of oil of lubricating viscosity.

DETAILED DESCRIPTION

Transmission lubricants are described that provide improved FZG anti-wear properties. The lubricants are particularly suited for automatic transmissions, such as but not limited to, dual clutch transmissions with a wet-clutch friction disc. Such results were obtained not by increasing the levels of sulfur and phosphorus, but by discovering compounds that more effectively deliver sulfur to the metal surface. Such compounds were not previously expected to affect FZG wear properties in such a dramatic fashion within transmission lubricants. In one aspect, the lubricants include a major amount of a base or lubricating oil(s) and select amounts of a thiadiazole derivative of Formula I as described previously above in the Summary.

As used herein, the terms "oil composition," "lubrication composition," "lubricating oil composition," "lubricating oil," "lubricant composition," "fully formulated lubricant composition," and "lubricant" are considered synonymous, fully interchangeable terminology referring to the finished lubrication product comprising a major amount of a base or lubricating oil plus minor amounts of the select dispersants and detergents noted herein. The lubricant may also include optional additives as further described below.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: (a) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic moiety); (b) substituted hydrocarbon substituents, that is, substituents containing non-hydrocarbon groups which, in the context of this disclosure, do not alter the predominantly hydrocarbon substituent (e.g., halo (especially chloro and fluoro), hydroxy, alkoxy, mercapto, alkylmercapto, nitro, nitroso, amino, alkylamino, and sulfoxy); and (c) hetero substituents, that is, substituents which, while having a predominantly hydrocarbon character, in the context of this disclosure, contain other than carbon in a ring or chain otherwise composed of carbon atoms. Heteroatoms may include sulfur, oxygen, and nitrogen, and encompass substituents such as pyridyl, furyl, thienyl, and imidazolyl. In general, no more than two, for example, no more than one, non-hydrocarbon substituent will be present for every ten carbon atoms in the hydrocarbyl group; typically, there will be no non-hydrocarbon substituents in the hydrocarbyl group.

Base Oil or Lubricating Oil

As used herein, the term "base oil" or "lubricating oil" generally refers to oils categorized by the American Petroleum Institute (API) category groups Group I-V oils as well as animal oils, vegetable oils (e.g. castor oil and lard oil), petroleum oils, mineral oils, synthetic oils, and oils derived from coal or shale. The American Petroleum Institute has categorized these different basestock types as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Hydrotreated basestocks and catalytically dewaxed basestocks, because of their low sulfur and aromatics content, generally fall into the Group II and Group III categories. Group IV base oils contain true synthetic molecular species, which are produced by polymerization of olefinically unsaturated hydrocarbons and are substantially free of sulfur and aromatics. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed lubricating oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricant compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene isobutylene copolymers); poly(1-hexenes), poly(1-octenes), trimers or oligomers of 1-decene, e.g., poly(1-decenes), such materials being often referred to as α-olefins, and mixtures thereof, alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

The lubricants may also include other optional additives as needed for particular applications as long as the optional components do not affect the basic features of the dispersants and detergents noted above. Several common optional additives are noted herein.

Optional Additive Components

In addition to the base oil and the thiadizole derivative of Formula I set forth above, the automatic transmission lubricating compositions herein may also include other additives to perform one or more functions required of a lubricating fluid. Further, one or more of the mentioned additives may be multi-functional and provide other functions in addition to or other than the function prescribed herein.

For example, the compositions herein may include one or more of at least one component selected from the group consisting of a friction modifier, an air expulsion additive, an antioxidant, a corrosion inhibitor, a foam inhibitor, a seal-swell agent, a viscosity index improver, anti-rust agent, extreme pressure additives, and combinations thereof. Other performance additives may also include, in addition to those specified above, one or more of metal deactivators, ashless TBN boosters, demulsifiers, emulsifiers, pour point depressants, and mixtures thereof. Typically, fully-formulated lubricating oils will contain one or more of these performance additives. Examples of some common optional additive components are set forth below.

Dispersants

The lubricant composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. N-substituted long chain alkenyl succinimides include polyisobutylene (PIB) substitutents with a number average molecular weight of the polyisobutylene substituent in a range of about 800 to about 2500 as determined by gel permeation chromatograph (GPC) using polystyrene (with a number average molecular weight of 180 to about 18,000) as the calibration reference). The PIB substituent used in the dispersant also has a viscosity at 100° C. of about 2100 to about 2700 cSt as determined using ASTM D445. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetra ethylene penta amine (TEPA), tri ethylene tetra amine (TETA), penta ethylene hexa amine (PEHA), other higher nitrogen ethylene diamine species and/or mixtures thereof. The polyamines may be mixtures of linear, branched and cyclic amines. The PIB substituents may be joined to each succinimide moiety.

In some embodiments the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, polyisobutylene (PIB), when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR-PIB having a number average molecular weight ranging from about 900 to about 3000, as measured by the GPC method described above, may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR-PIB may lead to higher conversion rates in the reaction, as well as lower amounts of sediment formation, due to increased reactivity.

In embodiments the lubricant composition comprises at least one dispersant derived from polyisobutylene succinic anhydride. In an embodiment, the dispersant may be derived from a polyalphaolefin (PAO) succinic anhydride. In an embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describes some suitable post-treatment methods and post-treated products.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid, the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable are the inorganic phosphorus halide compounds such as $PCl_3$, $PBr_3$, POCl, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment the lubricating oil composition may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m—[NH(CH_2)_m]_n—NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 140° to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 4.5 to about 25 weight percent and, in other approaches, about 4.5 to about 12 weight percent, and in yet other approaches, about 4.5 to about 7.7 weight percent in the lubricant.

Extreme Pressure Agents

The lubricating oil compositions herein may also optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

The extreme pressure agents may be present in amount of, for example, from 0 to 3.0 wt. % or from 0.1 to 2.0 wt. %, based on the total weight of the lubricating oil composition.

Friction Modifiers

The lubricating oil compositions herein may also optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

A friction modifier may optionally be present in ranges such as 0 wt. % to 6 wt. %, or 0.01 wt. % to 4 wt. %, or 0.05 wt. % to 2 wt. %.

Detergents

The lubricant composition also includes one or more select detergents or mixtures thereof to provide specific amounts of metal and soap content to the lubricating composition. By one approach, the detergent is a metal containing detergent, such as neutral to overbased detergents. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds and methylene bridged phenols. Suitable detergents and their methods of preparation are described in greater detail in numerous patent publications, including U.S. Pat. No. 7,732,390, and references cited therein. In one approach, the detergents are neutral to overbased sulfonates, phenates, or carboxylates with an alkali metal or alkaline earth metal salt. The detergents may be linear or branched, such as linear or branched sulfonates. Linear detergents are those that include a straight chain with no side chains attached thereto and typically include carbon atoms bonded only to one or two other carbon atoms. Branched detergents are those with one or more side chains attached to the molecule's backbone and may include carbon atoms bonded to one, two, three, or four other carbon atoms. In one embodiment the sulfonate detergent may be a predominantly linear alkylbenzenesulfonate detergent. In some embodiments the linear alkyl (or hydrocarbyl) group may be attached to the benzene ring anywhere along the linear chain of the alkyl group, but often in the 2, 3, or 4 position of the linear chain, and in some instances predominantly in the 2 position. In other embodiments, the alkyl (or hydrocarbyl) group may be branched, that is, formed from a branched olefin such as propylene or 1-butene or isobutene. Sulfonate detergents having a mixture of linear and branched alkyl groups may also be used.

The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being one of benzyl, tolyl, and xylyl.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol. In general, the terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, the MR, is greater than one. Such salts are commonly referred to as overbased, hyperbased, or superbased salts and may be salts of organic sulfur acids, carboxylic acids, or phenols. The detergents may also exhibit a total base number (TBN) of about 27 to about 307 and, in other approaches, about 200 to about 307.

In transmission fluids, the detergent provides less than about 455 ppm of the metal to the lubricant composition. Higher levels of metal result in failures in one or more of the friction durability or wear tests set forth herein. In other approaches, the detergent provides about 0 to about 281 ppm of metal. In yet other approaches, the detergent provides about 0 to about 100 ppm metal to the lubricant composition.

The detergent also provides select levels of soap content to the lubricant composition and the provided soap amounts are balanced with the level of metal such that if the metal is not within the desired ranges, then increasing soap content does not achieve desired results, which is discussed in more detail in the Examples herein. By one approach, the detergent provides about 0.02 to about 0.15 percent soap content to the final lubricating composition, such as sulfonate soap, phenate soap, and/or carboxylate soap. In other approaches, the detergent provides about 0.02 to about 0.1 percent soap, and in yet other approaches, about 0.02 to about 0.05 percent soap.

Soap content generally refers to the amount of neutral organic acid salt and reflects a detergent's cleansing ability, or detergency, and dirt suspending ability. The soap content can be determined by the following formula, using an exemplary calcium sulfonate detergent (represented by $RSO_3)_vCa_w(CO_3)(Oh)_y$, with v, w, x, and y denoting the number of sulfonate groups, the number of calcium atoms, the number of carbonate groups, and the number of hydroxyl groups respectively):

$$\text{soap content} = \frac{\text{formula weight of } [(RSO_3)_2Ca]}{\text{effective formula weight}} \times 100$$

Effective formula weight is the combined weight of all the atoms that make up the formula $(RSO_3)_vCa_w(CO_3)_x(OH)_y$ plus that of any other lubricant components. Further discussion on determining soap content can be found in FUELS AND LUBRICANTS HANDBOOK, TECHNOLOGY, PROPERTIES, PERFORMANCE, AND TESTING, George Totten, editor, ASTM International, 2003, relevant portions thereof incorporated herein by reference.

The treat rates of the detergent may be about 0.08 weight percent to about 1 weight percent based on the total weight of the lubricant composition. In some approaches, the metal containing detergent is not boronated such that the boron in the lubricant is solely provided by the dispersant.

The total amount of detergent that may be present in the lubricating oil composition may be from 0 wt. % to 2 wt. %, or from about 0 wt. % to about 0.5 wt. %, or about 0 wt. % to about 0.15 wt.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be 0 wt. % to 20 wt. %, 0.1 wt. % to 15 wt. %, 0.25 wt. % to 12 wt. %, or 0.5 wt. % to 10 wt. %, of the lubricating composition.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of 0.3 to 2% diarylamine and 0.4 to 2% high molecular weight phenol, by weight, based upon the final weight of the lubricating oil composition.

The one or more antioxidant(s) may be present in ranges 0 wt. % to 5 wt. %, or 0.01 wt. % to 5 wt. %, or 0.1 wt. % to 3 wt. %, or 0.8 wt. % to 2 wt. %, of the lubricating composition.

Corrosion Inhibitors

The automatic transmission lubricants may further include additional corrosion inhibitors (it should be noted that some of the other mentioned components may also have copper corrosion inhibition properties). Suitable additional inhibitors of copper corrosion include ether amines, polyethoxylated compounds such as ethoxylated amines and ethoxylated alcohols, imidazolines, monoalkyl and dialkyl thiadiazole, and the like.

Thiazoles, triazoles and thiadiazoles may also be used in the lubricants. Examples include benzotriazole; tolyltriazole; octyltriazole; decyltriazole; dodecyltriazole; 2-mercaptobenzothiazole; 2,5-dimercapto-1,3,4-thiadiazole; 2-mercapto-5-hydrocarbylthio-1,3,4-thiadiazoles; and 2-mercapto-5-hydrocarbyldithio-1,3,4-thiadiazoles. In one embodiment, the thiadiazoles are 1,3,4-thiadiazoles. In another embodiment, the thiadiazoles are 2-hydrocarbyldithio-5-mercapto-1,3,4-dithiadiazoles. A number of the thiadiazoles are available as articles of commerce.

The corrosion inhibitor, if present, can be used in an amount sufficient to provide 0 wt. % to 5 wt. %, 0.01 wt. % to t 3 wt. %, 0.1 wt. % to 2 wt. %, based upon the final weight of the lubricating oil composition.

Foam Inhibitors/Anti Foam Agents

Anti-foam/Surfactant agents may also be included in a fluid according to the present disclosure. Various agents are known for such use. In one embodiment, the agents are copolymers of ethyl acrylate and hexyl ethyl acrylate, such as PC-1244, available from Solutia. In another embodiment, the agents are silicone fluids, such as 4% DCF. In another embodiment, the agents are mixtures of anti-foam agents.

Anti-Rust Agents

Various known anti-rust agents or additives are known for use in transmission fluids, and are suitable for use in the fluids according to the present disclosure. The anti-rust agents include alkyl polyoxyalkylene ethers, such as Mazawet® 77, C-8 acids such as Neofat® 8, oxyalkyl amines such as Tomah PA-14, 3-decyloxypropylamine, and polyoxypropylene-polyoxyethylene block copolymers such as Pluronic® L-81.

Pour Point Depressants

Suitable pour point depressants may include polymethylmethacrylates or mixtures thereof. Pour point depressants may be present in an amount sufficient to provide from 0 wt. % to 1 wt. %, 0.01 wt. % to 0.5 wt. %, or 0.02 wt. % to 0.04 wt. %, based upon the total weight of the lubricating composition.

Seal-Swell Agents

The automatic transmission fluids of the present disclosure may further include seal swell agents. Seal swell agents such as esters, adipates, sebacates, azealates, phthalates, sulfones, alcohols, alkylbenzenes, substituted sulfolanes, aromatics, or mineral oils cause swelling of elastomeric materials used as seals in engines and automatic transmissions.

Alcohol-type seal swell agents are generally low volatility linear alkyl alcohols, such as decyl alcohol, tridecyl alcohol and tetradecyl alcohol. Alkylbenzenes useful as seal swell agents include dodecylbenzenes, tetradecylbenzenes, dinonyl-benzenes, di(2-ethylhexyl)benzene, and the like. Substituted sulfolanes (e.g. those described in U.S. Pat. No. 4,029,588, incorporated herein by reference) are likewise useful as seal swell agents in compositions according to the present disclosure. Mineral oils useful as seal swell agents in the present disclosure include low viscosity mineral oils with high naphthenic or aromatic content. Aromatic seal swell agents include the commercially available Exxon Aromatic 200 ND seal swell agent. Commercially available examples of mineral oil seal swell agents include Exxon® Necton®-37 (FN 1380) and Exxon® Mineral Seal Oil (FN 3200).

In general terms, a suitable lubricant may include additive components in the ranges listed in Table 1.

TABLE 1

| Component | Suitable Ranges, Weight Percent | Preferred Ranges, Weight Percent |
|---|---|---|
| Monohydrocarbyl-substituted dimercaptothiadiazole derivatives according to Formula I or tautomers or salted versions thereof | 0.001-.4 | 0.1-.3 |
| Dispersants | 0 to 10.0 | 1.0-8.0 |
| Detergents | 0.01 to 1 | 0.08 to 0.4 |
| Friction Modifiers | 0 to 6 | 0.005 to 4 |
| Viscosity Modifiers | 0 to 20 | 0 to 15 |
| Antioxidants | 0 to 5.0 | 0.05 to 3.0 |
| Rust inhibitors | 0 to 1 | 0.005 to 0.5 |
| Corrosion Inhibitors | 0 to 1.2 | 0.005 to 0.8 |
| Anti-wear agents | 0 to 5 | 0 to 3 |

TABLE 1-continued

| Component | Suitable Ranges, Weight Percent | Preferred Ranges, Weight Percent |
|---|---|---|
| Seal Swell Agents | 0 to 20 | 0 to 10 |
| Antifoam Agents | 0 to 1 | 0.001 to 0.15 |
| Extreme pressure agents | 0 to 2 | 0 to 1 |
| Lubricating Base Oils | Balance | Balance |
| Total | 100 | 100 |

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

A better understanding of the present disclosure and its many advantages may be clarified with the following examples. The following examples are illustrative and not limiting thereof in either scope or spirit. Those skilled in the art will readily understand that variations of the components, methods, steps, and devices described in these examples can be used. Unless noted otherwise, all percentages, ratios, and parts noted in this disclosure are by weight.

Examples

Lubricating compositions according to examples 1 to 5 as well as comparative examples 1 to 3 as shown in Table 2 have been prepared.

Synthesis example A was prepared by mixing 266 g of succinimide dispersant with 5.0 g DMTD and 46 g PAO-4, stirring under nitrogen protection at 110° C. for 1 h, then 130° C. for 1 h, and 140° C. for 1 h to give a dark brown oil.

Synthesis example B was prepared by mixing 221.3 g of succinimide dispersant with 8.27 g of a compound of Formula I, or a tautomer thereof, wherein R is methyl, (also referred to as 5-(methylthio)-3,4-thiadiazole-2(3H)-thione), stirring under nitrogen protection at 80° C. for 1.5 h, then 105° C. for 1 h to give a light brown oil.

Synthesis example C was prepared by mixing 428 g of succinimide dispersant with 20.4 g of Formula I, or a tautomer thereof, wherein R is methyl (also referred to as 5-(methylthio)-3,4-thiadiazole-2(3H)-thione), stirring under nitrogen at 90° C. for 30 minutes, then 100° C. for 30 minutes, then 105° C. for 1 h to give a light brown oil.

All examples and comparative examples have been formulated to comparable kinematic viscosity at 100° C. (KV100).

TABLE 2

| | Comp. Ex. 1 | Ex. 1 | Ex. 2 | Ex. 3 | Comp. Ex. 2 | Comp. Ex. 3 | Comp Ex. 4 | Ex. 4 |
|---|---|---|---|---|---|---|---|---|
| Succinimide dispersant[1] | 4 | — | 2 | 4 | 4 | — | 2.3 | 2.3 |
| Aromatic amine antioxidant | 0.4 | 0.4 | 0.4 | 0.4 | 0.4 | — | — | — |
| Synthesis Example A | — | — | — | — | — | 4.77 | — | — |
| Synthesis Example B | — | 4.3 | 2.2 | — | — | — | — | — |
| Synthesis Example C | — | — | — | — | — | — | 1.7 | 1.7 |
| Inventive agent delivered without dispersant[2] | — | — | — | 0.15 | 0.15 | — | — | — |
| Calcium Salicylate Detergent | — | — | — | — | — | — | 0.6 | — |
| Dibutyl hydrogen phosphite | — | — | — | — | 0.18 | — | — | — |
| Total succinimide dispersant | 4 | 4.15 | 4.12 | 4 | 4 | 4 | 3.92 | 3.92 |
| Total Inventive agent[2] | — | 0.15 | 0.08 | 0.15 | 0.15 | — | 0.08 | 0.08 |
| Total Conventional agent 1[3] | 0.3 | — | 0.1 | — | — | — | — | — |

TABLE 2-continued

| | Comp. Ex. 1 | Ex. 1 | Ex. 2 | Ex. 3 | Comp. Ex. 2 | Comp. Ex. 3 | Comp Ex. 4 | Ex. 4 |
|---|---|---|---|---|---|---|---|---|
| Total Conventional agent 2[4] | — | — | — | — | — | 0.1 | — | — |
| Group V synthetic dibasic ester base oil based on diisooctyl adipate | 5 | 5 | 5 | 5 | 5 | 5 | 5 | 5 |
| Base Oil 1[5] | 43.76 | 43.76 | 43.76 | 43.83 | 43.75 | 43.72 | 43.8 | 44.1 |
| Base Oil 2[6] | 46.54 | 46.54 | 46.54 | 46.62 | 46.52 | 46.51 | 46.6 | 46.9 |
| Total | 100 | 100 | 100 | 100 | 100 | 100 | 100 | 100 |
| FZG, FLS[7] | 5 | 9 | 9 | 9 | 8 | 3 | 7 | 9 |
| Total sulfur[8] | 1108 | 940 | 824 | 746 | 752 | 498 | 497 | 480 |
| KV100 | 5.294 | 5.369 | 5.341 | 5.312 | 5.294 | 5.33 | 5.324 | 5.285 |

All amounts shown in wt.%.

[1]The succinimide dispersant was a 950 MW succinimide dispersant.

[2]Inventive agent: 5-(methylthio)-3,4-thiadiazole-2(3H)-thione (R = methyl in Formula (I)

[3]Conventional agent 1: 85:15 mixture of 2,5-bis-(hydrocarbyldithio)-1,3,4-thiadiazole and 5-hydrocarbyldithio-2-mercapto-1,3,4-thiadiazole

[4]Conventional agent 2: dimercaptothiadiazole (R = H in Formula (I))

[5]Base Oil 1: PAO having kV 100 = 4 cSt

[6]Base Oil 2: PAO having kV 100 = 6 cSt

[7]FZG, FLS: FZG(A10/16.6R/90); FLS: Failure Load Stage as determined by CEC L-84-02

[8]Total Sulfur as determined by Inductively Coupled Plasma (ICP) spectrometry

A comparison of Examples 1 and 2 with Comparative Example 1 shows that despite the lower sulfur levels delivered by the inventive agent, the lubricating compositions of the present disclosure outperform the conventional lubricating composition comprising 2,5-bis-(hydrocarbyldithio)-1,3,4-thiadiazole. A particular synergism is observed in Example 2 wherein the combination of a conventional mixture of 2,5-bis-(hydrocarbyldithio)-1,3,4-thiadiazole and its monohydrocarbyl derivative with the inventive agent leads to the same FZG test performance at even lower sulfur levels.

A comparison of Example 3 with Comparative Example 2 shows that phosphite has a detrimental influence on FZG test performance.

A comparison of Comparative Examples 3 and 4 with Example 4 shows that the inventive agent outperforms DMTD and that FZG test performance is even enhanced in the absence of a detergent, in particular a salicylate detergent.

TABLE 3

| | Comp. Ex. 5 | Ex. 5 |
|---|---|---|
| Commercial Formulation* | 99.84 | 99.84 |
| Conventional Agent[2] | 0.16 | |
| Inventive compound delivered without dispersant | | 0.16 |
| Total | 100 | 100 |
| FZG, FLS | 5 | 8 |
| S-ICP | 1240 | 1547 |
| kV100 | 6.18 | 6.12 |

*Commercial Formulation contains: extreme pressure agent, succinimide friction modifiers, aminic friction modifiers, aromatic amine antioxidant, borated and phosphorylated succinimide dispersant, 300 TBN calcium sulfonate detergent, antifoam agents, process oil, polymethacrylate viscosity modifiers, ester base oils, and Group 3 base oils.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When the word "about" is used herein in reference to a number, it should be understood that still another embodiment of the invention includes that number not modified by the presence of the word "about." Unless understood otherwise by the context of this disclosure, all numbers herein are modified by the word "about."

It should also be understood that, unless clearly indicated to the contrary, in any methods claimed herein that include more than one step or act, the order of the steps or acts of the method is not necessarily limited to the order in which the steps or acts of the method are recited unless suggested by the context of the method.

In the claims, as well as in the specification above, all transitional phrases such as "comprising" "including" "carrying," "having" "containing" "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedure, Revision 07.2015, Section 2111.03.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the compositions and methods described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A lubricating composition comprising a) a major part of a base oil of lubricating viscosity wherein the base oil is selected from the group consisting of API Group I, II, III, IV, V, and mixtures thereof, b) a total of 0.08 to 0.15 wt. %, based on the total lubricating composition, of one or more monohydrocarbyl-substituted dimercaptothiadiazole derivative(s) according to Formula (I), or a tautomer thereof, below Formula I

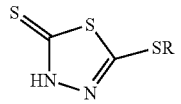

wherein R is methyl, wherein the total lubricating composition has a sulfur content of 480 to 940 ppm (wt.), and c) wherein the lubricating composition is free of phosphite.

2. The lubricating composition according to claim 1, wherein the one or more monohydrocarbyl-substituted dimercaptothiadiazole derivative(s) comprise 5-(methylthio)-3,4-thiadiazole-2(3H)-thione.

3. The lubricating composition according to claim 1, wherein the lubricating composition further contains a dispersant.

4. The lubricating composition according to claim 3 wherein the dispersant is present in an amount of 0.001 to 10 wt. %, based on the total lubricating composition, in the lubricating composition.

5. The lubricating composition according to claim 3 wherein the dispersant is selected from the group consisting of ashless dispersants, borated ashless dispersants, ash-containing dispersants, and dispersant viscosity index improvers, and combinations thereof.

6. The lubricating composition according to claim 1, further comprising one or more additives selected from the group consisting of extreme-pressure agents, anti-wear agents, friction modifiers, metal deactivators, detergents, viscosity index improvers, antioxidants, corrosion inhibitors, foam inhibitors, demulsifiers, pour point depressants, seal swelling agents, and mixtures thereof.

7. The lubricating composition according to claim 1 comprising 0.08 to 0.15 wt. % of the one or more monohydrocarbyl-substituted dimercaptothiadiazoles and 0.05 to 0.20 wt. % of at least one of:

monohydrocarbylthio-substituted dimercaptothiadiazoles of Formula IIa and bishydrocarbylthio-substituted dimercaptothiadiazoles of Formula II Formula (II)

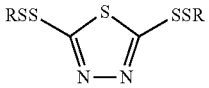

Formula (IIa)

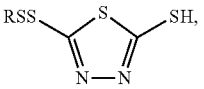

wherein each R is independently $C_5$-$C_{15}$ alkyl.

8. A method for lubricating a driveline, a transmission including a manual or automated transmission, a gear, an automated gear, or an axle, the method comprising lubricating the driveline, the transmission, the gear, the automated gear, or the axle with a lubricating composition, the lubricating composition comprising:

a) a major part of a base oil of lubricating viscosity wherein the base oil is selected from the group consisting of API Group I, II, III, IV, V, and mixtures thereof, b) a total of 0.08 to 0.15 wt. %, based on the total lubricating composition, of one or more monohydrocarbyl-substituted dimercaptothiadiazole derivative(s) according to Formula (I), or a tautomer thereof, below Formula I

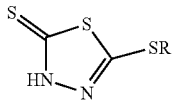

wherein R is methyl, wherein the total lubricating composition has a sulfur content of 480 to 940 ppm (wt.), and c) wherein the lubricating composition is free of phosphite.

9. The method according to claim 8, wherein the lubricating composition is for enhanced FZG test performance.

10. The method according to claim 8, wherein the lubricating composition is to enhance the gear scuffing resistance of the lubricating composition.

11. The method according to claim 9, wherein the enhanced FZG test performance comprises an enhanced Failure Load Stage (FLS) score.

12. A method of preparing a lubricating composition comprising blending a base oil of lubricating viscosity with one or more monohydrocarbyl-substituted dimercaptothiadiazole derivative(s) according to Formula (I) or a tautomer thereof Formula I

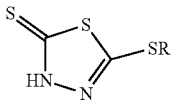

wherein R is methyl;

wherein the base oil is selected from the group consisting of API Group I, II, III, IV, V, and mixtures thereof;

wherein the lubricating composition has a sulfur content of 480 to 940 ppm (wt.) and is free of phosphite; and wherein the lubricating composition comprises from 0.08 to 0.15 wt % of the monohydrocarbyl-substituted dimercaptothiadiazole derivative(s).

13. The lubricating composition according to claim 3 wherein the dispersant is an ashless dispersant selected from the group consisting of succinimide dispersants, polyisobutylene dispersants, and ethylene-propylene copolymers, and mixtures thereof.

* * * * *